US012753917B2

(12) United States Patent
Peng et al.

(10) Patent No.: US 12,753,917 B2
(45) Date of Patent: Oct. 6, 2026

(54) GAS HEATER

(71) Applicant: BAIDE HOME (XIAMEN) OUTDOOR PRODUCTS CO., LTD., Fujian (CN)

(72) Inventors: Qingguo Peng, Fujian (CN); Trent Farrer, Fujian (CN)

(73) Assignee: BAIDE HOME (XIAMEN) OUTDOOR PRODUCTS CO., LTD., Fujian (CN)

( * ) Notice: Subject to any disclaimer, the term of this patent is extended or adjusted under 35 U.S.C. 154(b) by 394 days.

(21) Appl. No.: 18/429,407

(22) Filed: Jan. 31, 2024

(65) Prior Publication Data

US 2024/0175573 A1 May 30, 2024

(30) Foreign Application Priority Data

Mar. 23, 2023 (CN) ..... 202320587175.1

(51) Int. Cl.
*F23D 14/02* (2006.01)
*F23D 14/58* (2006.01)

(52) U.S. Cl.
CPC ..... *F23D 14/02* (2013.01); *F23D 14/58* (2013.01); *F23D 2207/00* (2013.01)

(58) Field of Classification Search
CPC ..... F24C 3/006; F24C 3/08; F24H 3/006
See application file for complete search history.

(56) References Cited

U.S. PATENT DOCUMENTS 4,478,205 A * 10/1984 Koziol ..... A47J 37/0713 126/41 R
4,488,534 A * 12/1984 Koziol ..... A47J 37/0682 126/41 R
4,686,957 A * 8/1987 Koziol ..... A47J 37/0713 126/41 R
4,762,530 A * 8/1988 Koziol ..... A47J 37/0713 126/41 R
4,989,579 A * 2/1991 Murphy ..... A47J 37/0713 126/41 R
6,398,322 B1 * 6/2002 Chaplin ..... A47F 3/12 312/140
9,982,888 B2 * 5/2018 Angulo ..... F24C 3/085
D891,594 S * 7/2020 Farrer ..... D23/343
D893,004 S * 8/2020 Farrer ..... D23/343
(Continued)

FOREIGN PATENT DOCUMENTS

DE 29800583 U1 * 5/1999 ..... F24C 7/083
WO WO-2017181056 A1 * 10/2017 ..... F23Q 13/02

*Primary Examiner* — Jorge A Pereiro
(74) *Attorney, Agent, or Firm* — Birchwood IP

(57) ABSTRACT

A gas heater having a heater body, a support, and a gas inlet pipe; a bottom of the heater body has a mounting cavity whose side wall has a through hole and in which the support is arranged; a mounting hole is formed on the support; an input end of the gas inlet pipe is detachably mounted to the through hole or to the mounting hole. By arranging the through hole on one side of the heater body and the mounting hole on the support, the input end of the gas inlet pipe can be selectively connected to the side surface or to the bottom surface of the heater body where it may further connect to a hose according to actual application requirements, thereby enabling relatively flexible use and more diversified application scenarios.

8 Claims, 7 Drawing Sheets

(56) References Cited

U.S. PATENT DOCUMENTS

| | | | | |
|---|---|---|---|---|
| 11,199,341 | B2 * | 12/2021 | Liu | F24H 9/02 |
| D995,736 | S * | 8/2023 | Yan | D23/339 |
| 2006/0054160 | A1 * | 3/2006 | Borowske | F24B 3/00 126/512 |
| 2008/0264408 | A1 * | 10/2008 | Konkle | F24C 3/006 126/519 |
| 2017/0350600 | A1 * | 12/2017 | Jenkins | F24C 3/006 |
| 2018/0172283 | A1 * | 6/2018 | Cragar | F24C 15/02 |
| 2019/0162411 | A1 * | 5/2019 | Choi | A47J 37/0786 |
| 2020/0248910 | A1 * | 8/2020 | Hawkinson | A47B 13/08 |
| 2024/0369227 | A1 * | 11/2024 | Burch | F24B 1/181 |

* cited by examiner

GAS HEATER

BACKGROUND OF THE INVENTION

The present invention relates to the technical field of stoves, and in particular to a novel gas heater.

A gas heater is a type of stove, and is mainly used in courtyards and outdoors to realize functions of heating, barbecue, decoration, atmosphere creation and the like. An independent gas heater is usually used with a table, that is to say, the gas heater is placed on the table top and is connected to an external gas cylinder by means of a hose.

In the related art, there are generally two types of interfaces for connecting a hose with a gas heater. One is a side interface, i.e., an interface arranged on a side surface of a body of a gas heater, where the hose extends across the table top and occupies part of the space of the table top, which may cause inconvenience to a user. Another type is shown in "FIRE EFFECT DEVICE AND ATTACHMENT FOR PROVIDING FIRE ON TABLE TOP" disclosed by CN205878246U, where an interface is arranged at a bottom of the gas heater; the gas heater can be used in conjunction with a table having a through hole, and the hose extends downwards through the through hole to a bottom space of the table and connects to a gas cylinder.

Apparently, these two types of interfaces are alternatives where each type is specified for a specific use. The side interface type cannot solve the problem of occupying the space of the table top, while the bottom interface type needs to be used in conjunction with a table having a through hole, so none of them can provide users with diversified uses, thus resulting in limitations.

BRIEF SUMMARY OF THE INVENTION

It is an object of the present invention to provide a novel gas heater, in which an interface can be selectively arranged at a suitable position according to actual use scenarios, thereby enabling relatively flexible use.

To achieve the above object, the present invention provides the following technical solutions:

A gas heater, comprising a heater body, a support, and a gas inlet pipe; a bottom of the heater body is provided with a mounting cavity, and a through hole is formed on a side wall of the mounting cavity; the support is arranged in the mounting cavity, and a mounting hole is formed on the support; an input end of the gas inlet pipe is detachably mounted to the through hole or to the mounting hole.

The gas heater also comprises a plug that blocks the through hole when the input end of the gas inlet pipe is not mounted to the through hole.

The support comprises a transverse plate, two vertical plates, and two wing plates, wherein one end of each of the two vertical plates is connected to a corresponding one of two ends of the transverse plate and positioned perpendicular to the transverse plate, and each of the two wing plates is connected to another end of a corresponding vertical plate and extending outwards from the corresponding vertical plate; the wing plates are mounted at a bottom surface of the mounting cavity, and the mounting hole is formed at a middle part of the transverse plate.

A combustion cavity is formed at a top of the heater body; a wind-shielding assembly is detachably mounted around the combustion cavity; the wind-shielding assembly comprises a plurality of separator plates.

Preferably, the wind-shielding assembly further comprises a mounting seat mounted to each corner of the combustion cavity; each mounting seat is provided with a claw that hooks at a corresponding corner of the combustion cavity; each mounting seat also comprises slots in which adjacent separator plates are inserted respectively.

The input end of the gas inlet pipe is a screw joint, and the screw joint penetrates through the through hole or the mounting hole and is fixed by a nut.

The gas heater also comprises a gas valve and a gas outlet pipe which are arranged in the mounting cavity, and also comprises a burner and an ignition device which are arranged at the top of the heater body; an output end of the gas inlet pipe is in communication with an input end of the gas valve; two ends of the gas outlet pipe are in communication with an output end of the gas valve and an input end of the burner respectively; the ignition device is arranged on one side of the burner.

Preferably, a control switch is arranged on a side surface of the heater body; the control switch is configured to control the gas valve and the ignition device; the ignition device comprises a gas collecting hood arranged on one side of the burner, and an ignition pin and a thermocouple arranged in the gas collecting hood.

Preferably, the burner is provided with a pipe adapter connecting an output end of the gas outlet pipe; a penetrating hole enabling the pipe adapter to penetrate through is formed in the heater body; a sealing piece is mounted at the penetrating hole.

Preferably, at least one gas inlet hole is arranged on a circumferential surface of the pipe adapter.

According to the above structures, the present invention has the following technical effects:

By arranging the through hole on a side surface of the heater body and arranging the mounting hole on the support arranged in the mounting cavity, the input end of the gas inlet pipe can have two assembling positions, i.e., the side surface and the bottom surface of the heater body respectively, so that the input end of the gas inlet pipe can be selectively fixed at a proper position among one of two different positions to realize connection to the hose according to actual application requirements, thereby enabling relatively flexible use and more diversified application scenarios.

REFERENCE NUMERALS IN THE FIGURES

Figure 1:
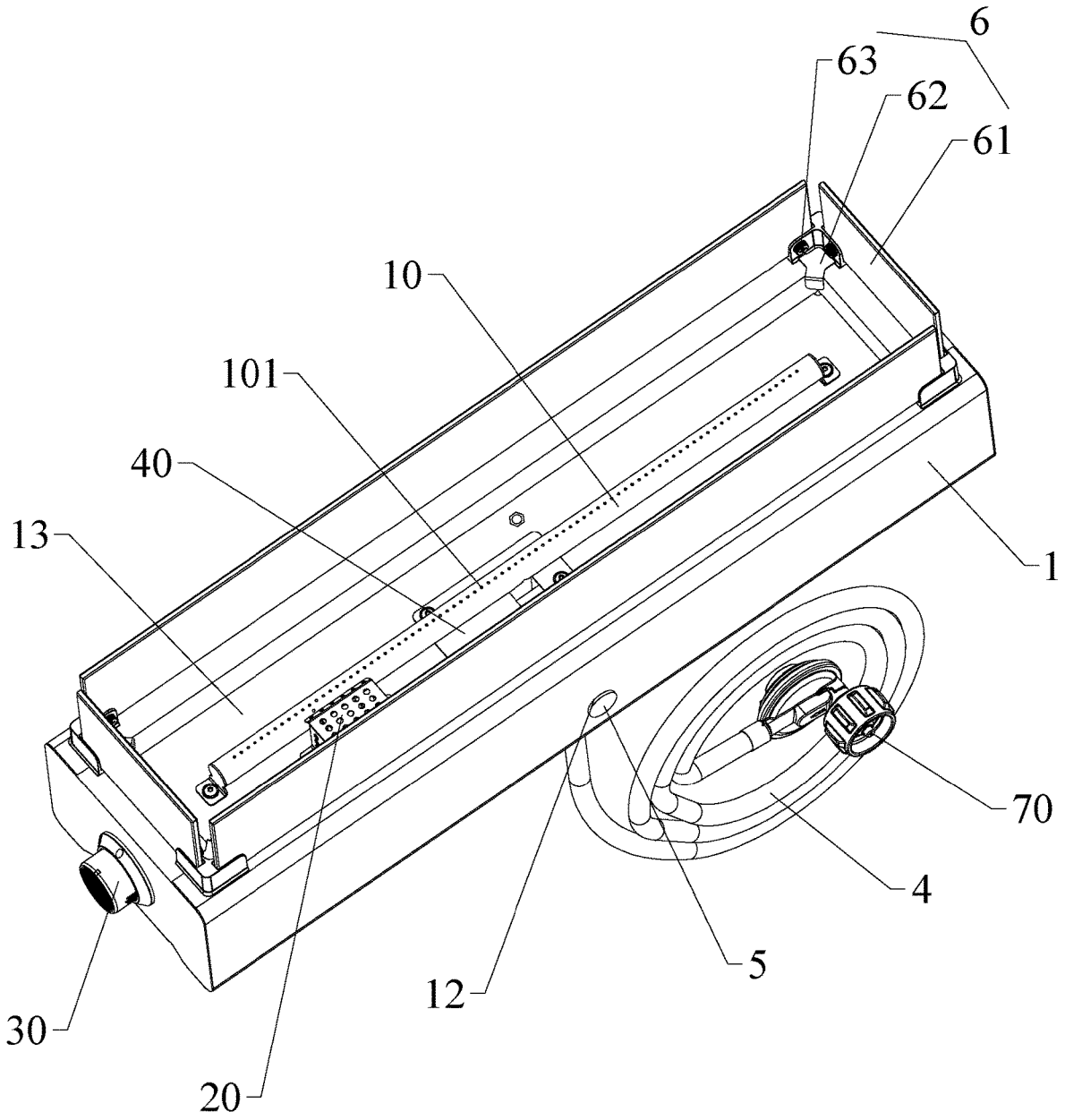
FIG. 1 is a first perspective view of a specific embodiment according to the present invention.

1—heater body; 11—mounting cavity; 12—through hole; 13—combustion cavity; 14—penetrating hole;

2—support; 21—transverse plate; 211—mounting hole; 22—vertical plate; 23—wing plate;

3—gas inlet pipe; 31—screw joint;

4—hose;
5—plug;
6—wind-shielding assembly; 61—separator plate; 62—mounting seat; 621—claw; 622—slot; 63—grub screw;
7—nut;
8—gas valve;
9—gas outlet pipe; 91—nozzle;
10—burner; 101—gas outlet hole; 102—pipe adapter; 103—gas inlet hole;
20—ignition device; 201—gas collecting hood; 202—ignition pin; 203—thermocouple;
30—control switch;
40—sealing piece;
50—insect-proof net;
60—adjustable foot pad;
70—pressure relief valve.

DETAILED DESCRIPTION OF THE INVENTION

To further explain the technical solutions of the present invention, a detailed description of the present invention is provided below through specific embodiments.

Referring to FIGS. 1 to 7, the present invention discloses a novel gas heater, comprising a heater body 1, a support 2 and a gas inlet pipe 3.

A bottom of the heater body 1 is provided with a mounting cavity 11, and a through hole 12 is formed on a side wall of the mounting cavity 11;

the support 2 is arranged in the mounting cavity 11, and a mounting hole 211 is formed on the support; and an input end of the gas inlet pipe 3 is detachably mounted to the through hole 12 or to the mounting hole 211, and the input end of the gas inlet pipe 3 is connected to a hose 4 adapted to be in communication with a gas tank/gas cylinder.

Specific embodiments of the present invention are described as follows.

The present invention also comprises a plug 5. The plug 5 is used to block the through hole 12 when the input end of the gas inlet pipe 3 is not mounted to the through hole 12.

A combustion cavity 13 is formed at a top of the heater body 1; a wind-shielding assembly 6 is detachably mounted around the combustion cavity 13; the wind-shielding assembly 6 comprises a plurality of separator plates 61, which may be made of materials such as glass, thus achieving effects of shielding wind, gathering fire, concentrating heat, decorating and the like.

Figure 4:
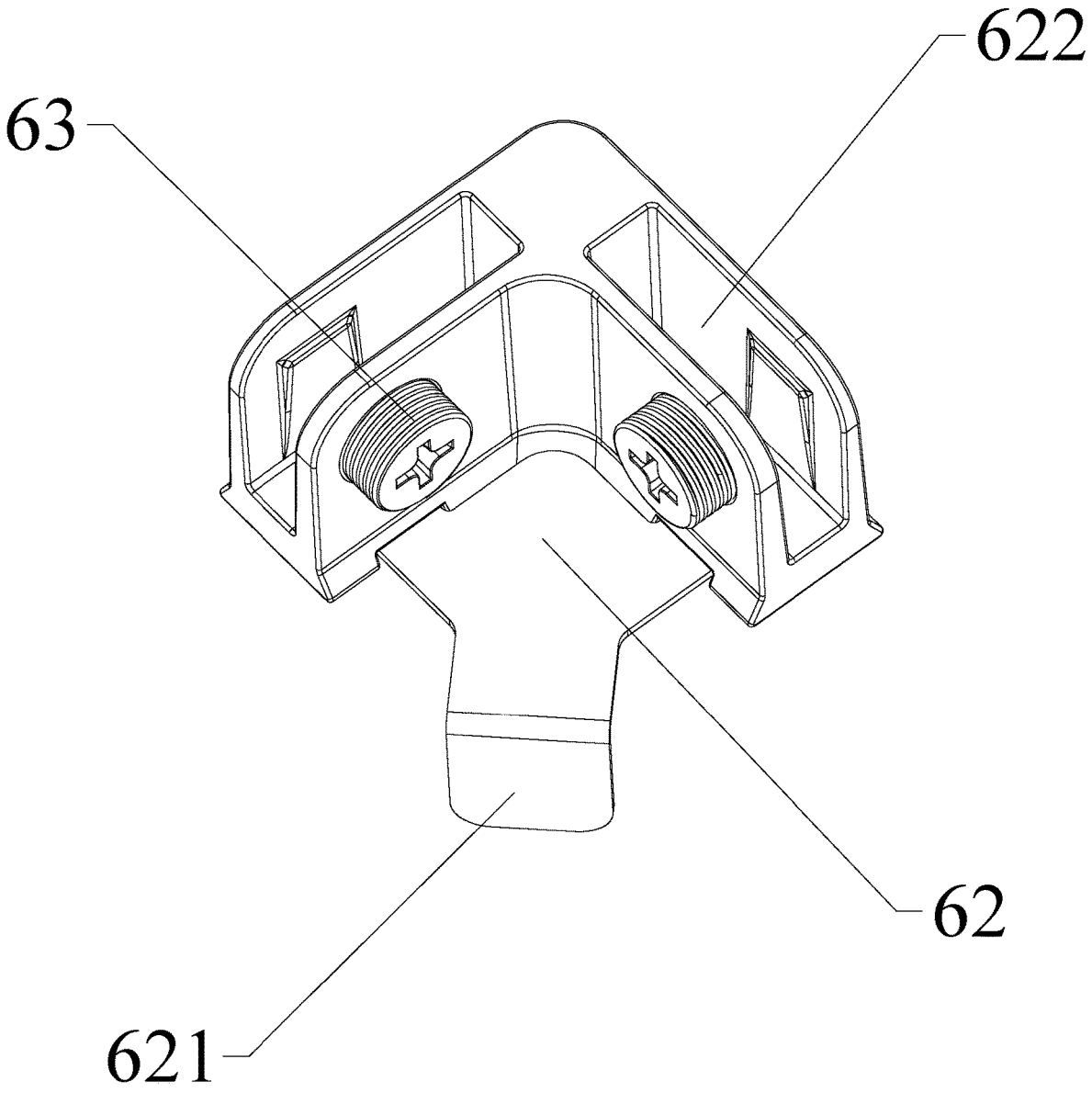
FIG. 4 is a perspective view of a mounting seat of a specific embodiment according to the present invention.

Furthermore, the wind-shielding assembly 6 further comprises a mounting seat 62 mounted to each corner of the combustion cavity 13, as shown in FIG. 4; the mounting seat 62 may be made of angle iron and is provided with a claw 621 that hooks at a corresponding corner of the combustion cavity 13; the mounting seat 62 also comprises slots 622 in which adjacent separator plates 61 are inserted respectively, and the adjacent separator plates 61 inserted into the slots 622 are fixed and locked by grub screws 63 respectively; the adjacent separator plates 61 being fixed and locked by the grub screws 63 form a one whole piece with the mounting seat 62. Therefore, the wind-shielding assembly 6 can be lifted and disposed as a whole, i.e., being lifted from the combustion cavity 13 or mounted around the combustion cavity 13, for easier mounting and dismounting. In this embodiment, the combustion cavity 13 has four corners, and each corner is provided with said mounting seat 62.

The support 2 comprises a transverse plate 21, two vertical plates 22, and two wing plates, wherein one end of each of the two vertical plates 21 is connected to a corresponding one of two ends of the transverse plate 21 and positioned perpendicular to the transverse plate 21, and each of the two wing plates 23 is connected to another end of a corresponding vertical plate 22 and extending outwards from the corresponding vertical plate 22. In other words, the support 2 has an U shape. The wing plates 23 are detachably mounted at a bottom surface of the mounting cavity 11 by detachable connection such as screws, and the mounting hole 211 is formed at a middle part of the transverse plate 21. By mounting the support 2 at the bottom surface of the mounting cavity 11 via the wing plates 23, the transverse plate 21 can be relatively easier to be hidden in the mounting cavity 11, so that by means of the support 2, the input end of the gas inlet pipe 3 is hidden in the mounting cavity 11 and will not be exposed, thus avoiding occupying additional space, facilitating packing, and saving storage and transportation costs.

The input end of the gas inlet pipe 3 is a screw joint 31, and the screw joint 31 penetrates through the through hole 12 or the mounting hole 211 and is fixed by a nut 7. Also, the screw joint 31 can be conveniently and quickly assembled with and disassembled from an end of the hose 4.

The present invention also comprises a gas valve 8 and a gas outlet pipe 9 which are arranged in the mounting cavity 11, and also comprises a burner 10 and an ignition device 20 which are arranged at the top of the heater body 1 (that is, in the combustion cavity 13); an output end of the gas inlet pipe 3 is in communication with an input end of the gas valve 8; two ends of the gas outlet pipe 9 are in communication with an output end of the gas valve 8 and an input end of the burner 10 respectively; the ignition device 20 is arranged on one side of the burner 10. The gas inlet pipe 3 and the gas outlet pipe 9 can both be corrugated pipes.

In some embodiments of the present invention, a control switch 30 is arranged on a side surface of the heater body 1; the control switch 30 controls the gas valve 8 and the ignition device 20.

In some embodiments of the present invention, the burner 10 is a cylinder with a plurality of gas outlet holes 101, and two ends of the cylinder are closed.

Figure 5:
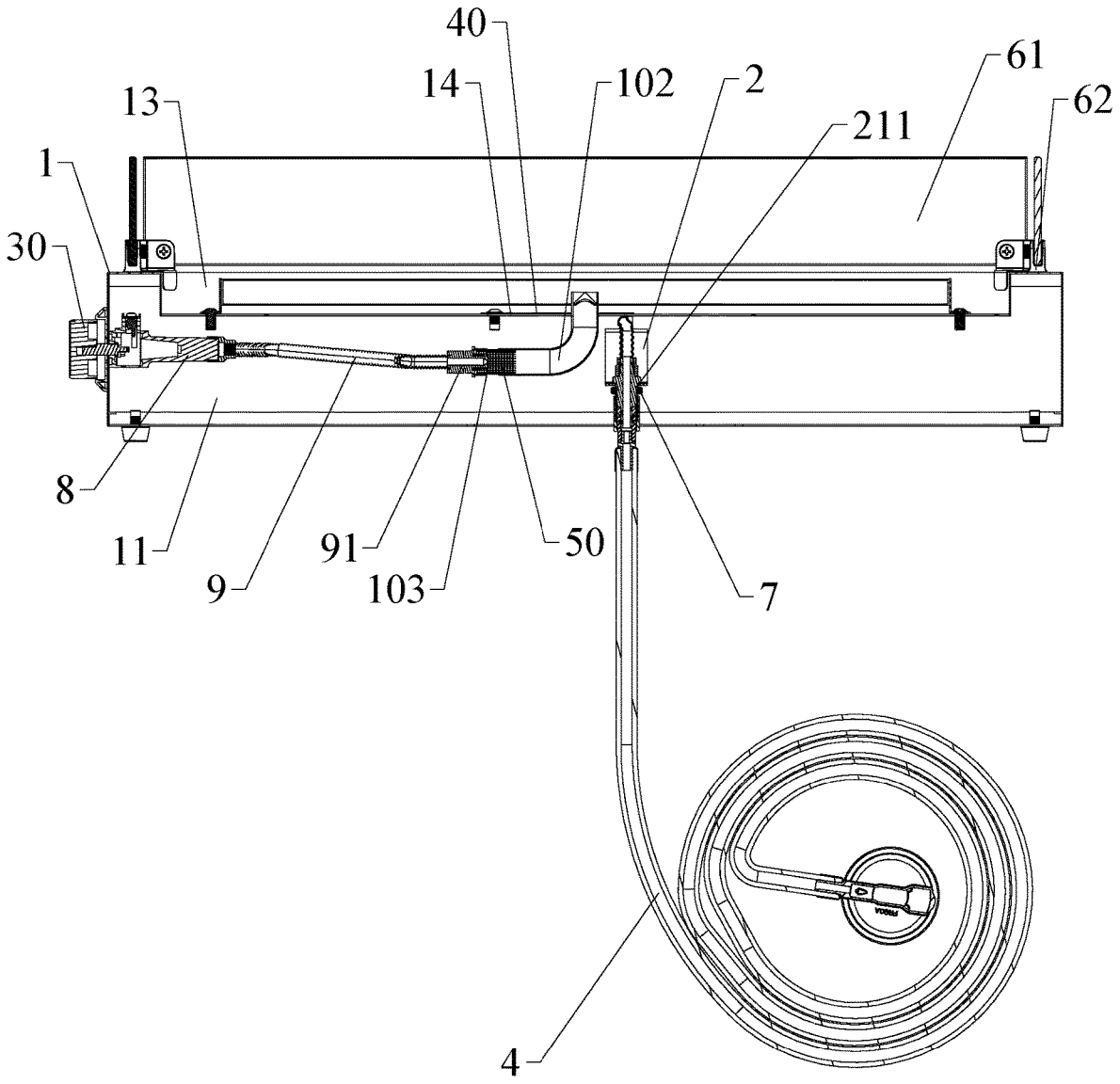
FIG. 5 is a first cross-sectional view of a specific embodiment according to the present invention.

As shown in FIG. 5, in some embodiments of the present invention, the burner 10 is provided with a pipe adapter 102 connecting an output end of the gas outlet pipe 9; a penetrating hole 14 enabling the pipe adapter 102 to penetrate through is formed in the heater body 1, and the penetrating hole 14 penetrates upwards from the bottom surface of the mounting cavity 11 up to the top of the heater 1; and a sealing piece 40 is mounted at the penetrating hole 14. By forming the penetrating hole 14 in the heater body 1, mounting of the burner 10 can be facilitated, and after the burner 10 is mounted, the penetrating hole 14 is covered by the sealing piece 40.

Further, at least one gas inlet hole 103 is arranged on a circumferential surface of the pipe adapter 102. When the gas valve 8 is opened and gas is delivered to the gas outlet holes 101 of the burner 10 through the gas outlet pipe 9, air is drawn into the pipe adapter 102 and into the burner 10 from said at least one gas inlet hole 103 due to negative pressure formed in the burner 10, such that the gas and the air are better mixed to achieve full combustion.

Also, the output end of the gas outlet pipe 9 is provided with a nozzle 91 to realize acceleration of the gas into the pipe adapter 102; and said at least one gas inlet hole 103 is arranged at a position of the circumferential surface of the pipe adapter 102 adjacent to the output end of the nozzle 91, so as to enable better air intake by utilizing negative pressure principle.

Further, an insect-proof net 50 is arranged in the pipe adapter 102, which can prevent mosquitoes, spiders and other small creatures from entering the pipe adapter and damaging the present invention.

Figure 6:
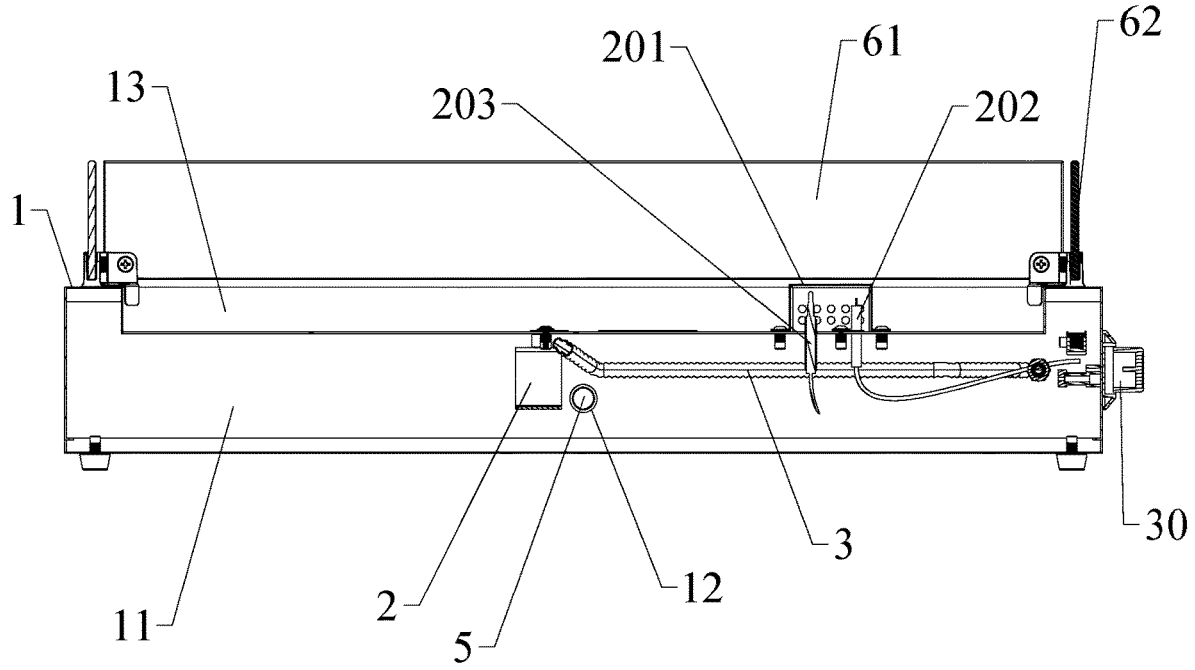
FIG. 6 is a second cross-sectional view of a specific embodiment according to the present invention.

As shown in FIG. 6, in some embodiments of the present invention, the ignition device 20 comprises a gas collecting hood 201 arranged on one side of the burner 10, and an ignition pin 202 and a thermocouple 203 arranged in the gas collecting hood 201.

Four corners of a bottom surface of the heater body 1 are provided with adjustable foot pads 60 respectively; the adjustable foot pads 60 are in threaded connection with the heater body 1; adjustable foot pads 60 can be rotated to achieve height adjustments of the adjustable foot pads 60, so as to adapt to the requirements of different usage scenarios.

An input end of the hose 4 is provided with a pressure relief valve 70, so as to reduce pressure when the gas is delivered.

Figure 2:
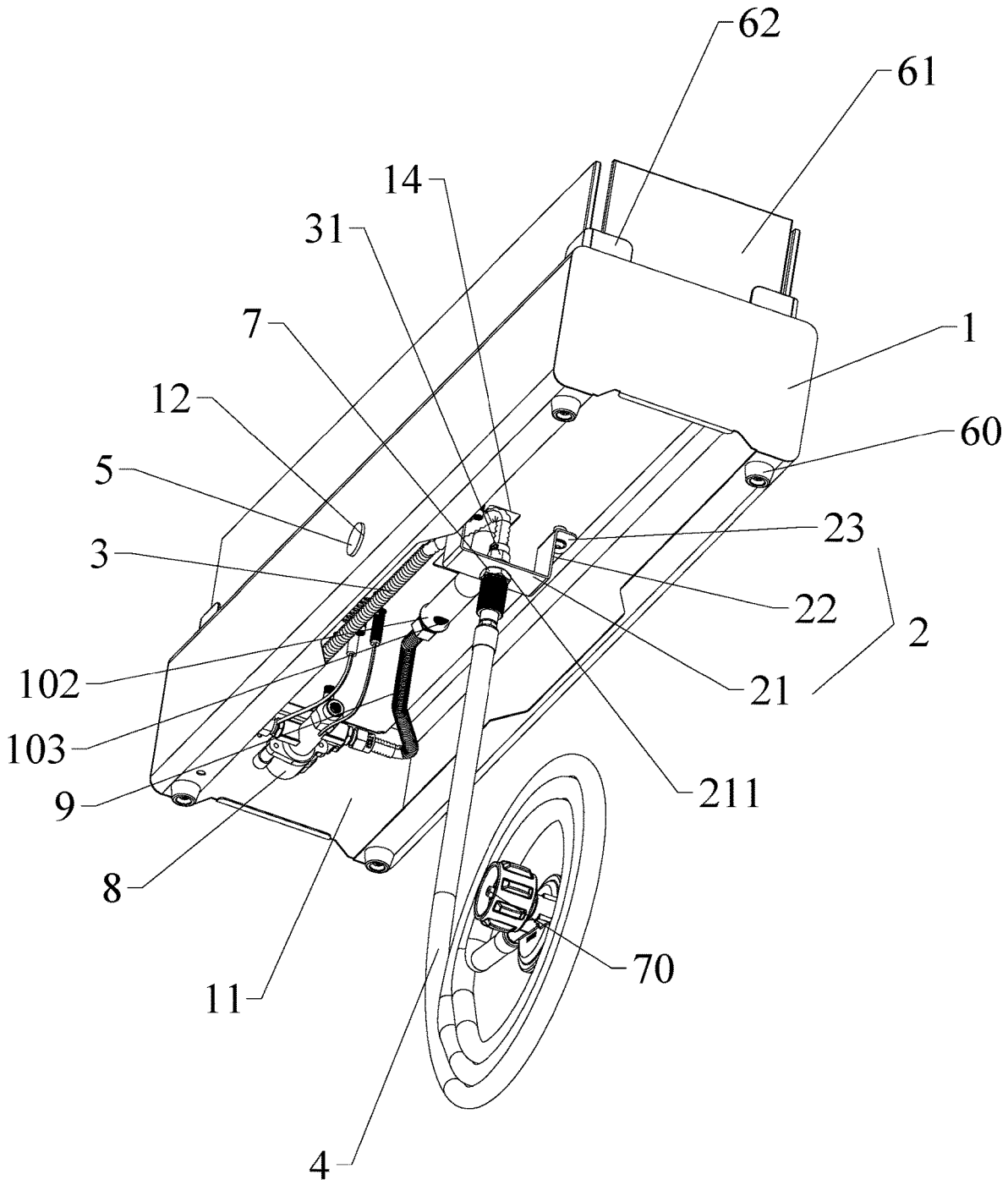
FIG. 2 is a second perspective view of a specific embodiment according to the present invention.
Figure 3:
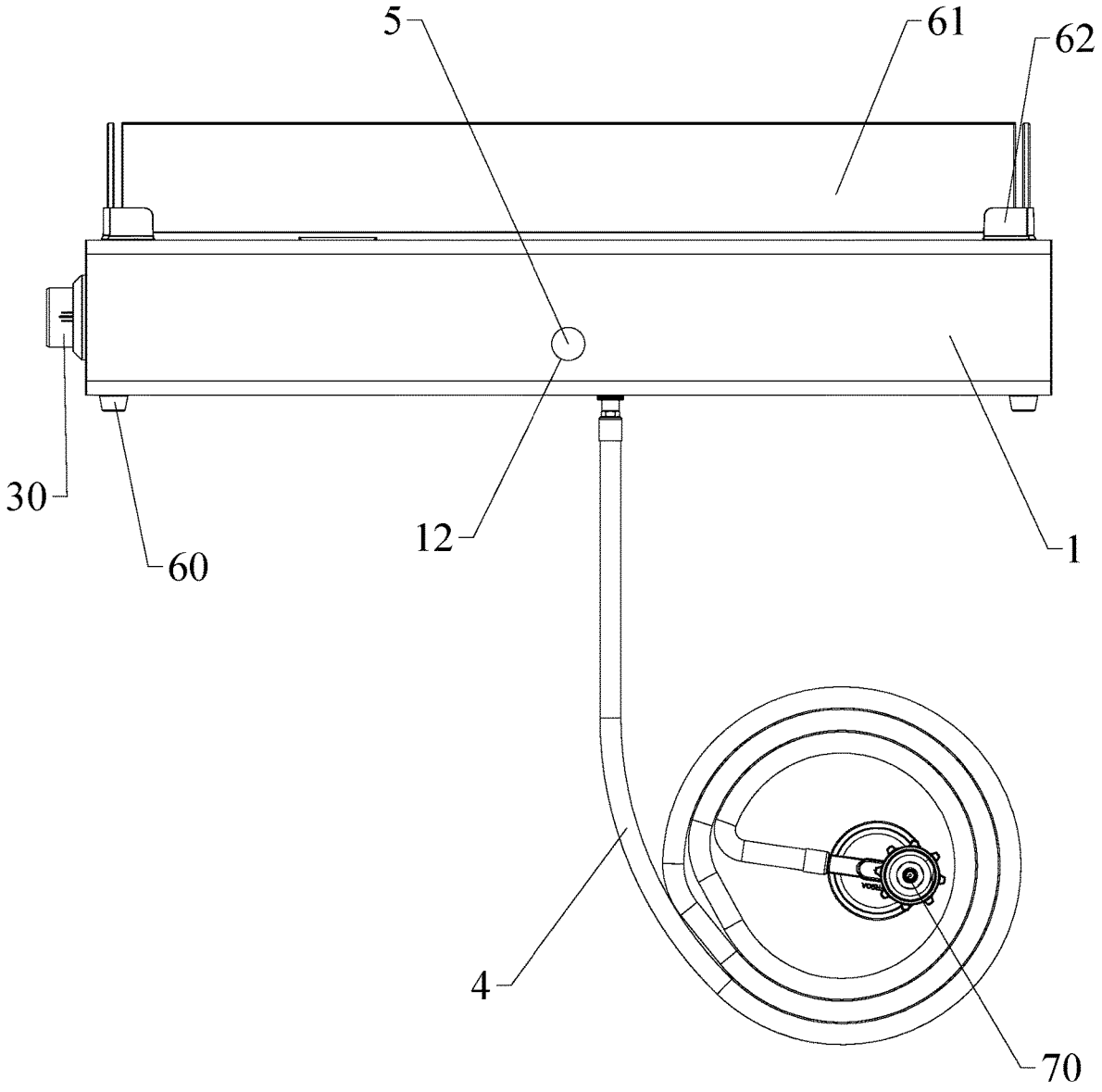
FIG. 3 is a front view of a specific embodiment according to the present invention.
Figure 7:
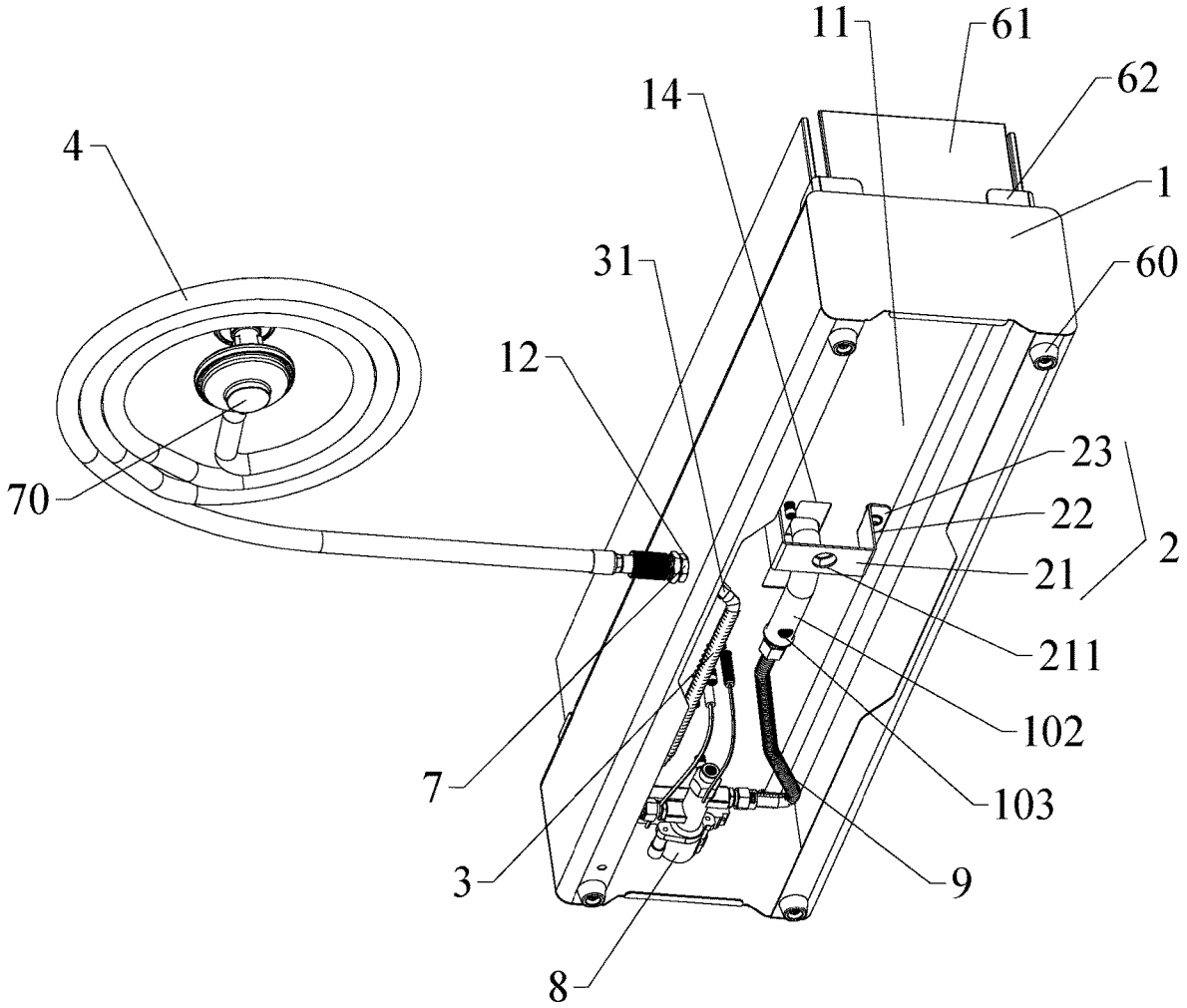
FIG. 7 is a schematic illustration showing the input end of the gas inlet pipe mounted at the through hole.

According to the above solutions of the present invention, as shown in FIG. 2 and FIG. 7, by arranging the through hole 12 on a side surface of the heater body 1 and arranging the mounting hole 211 on the support 2 arranged in the mounting cavity 11, the input end of the gas inlet pipe 3 can have two assembling positions, i.e., the side surface and the bottom surface of the heater body 1 respectively, so that the input end of the gas inlet pipe 3 can be selectively fixed at a proper position among one of two different positions to realize connection to the hose 4 according to actual application requirements, thereby enabling relatively flexible use and more diversified application scenarios.

What is claimed is:

1. A gas heater, comprising a heater body, a support, and a gas inlet pipe;

a bottom of the heater body is provided with a mounting cavity, and a through hole is formed on a side wall of the mounting cavity;

the support is arranged in the mounting cavity, and a mounting hole is formed on the support;

an input end of the gas inlet pipe is detachably mounted to the through hole or to the mounting hole;

the gas heater also comprises a gas valve and a gas outlet pipe which are arranged in the mounting cavity, and also comprising a burner and an ignition device which are arranged at a top of the heater body; an output end of the gas inlet pipe is in communication with an input end of the gas valve; two ends of the gas outlet pipe are in communication with an output end of the gas valve and an input end of the burner respectively; the ignition device is arranged on one side of the burner;

the burner is provided with a pipe adapter connecting an output end of the gas outlet pipe; a penetrating hole enabling the pipe adapter to penetrate through is formed in the heater body; a sealing piece is mounted at the penetrating hole.

2. The gas heater of claim 1, also comprising a plug that blocks the through hole when the input end of the gas inlet pipe is not mounted to the through hole.

3. The gas heater of claim 1, wherein the support comprises a transverse plate, two vertical plates, and two wing plates, wherein one end of each of the two vertical plates is connected to a corresponding one of two ends of the transverse plate and positioned perpendicular to the transverse plate, and each of the two wing plates is connected to another end of a corresponding vertical plate and extending outwards from the corresponding vertical plate; the wing plates are mounted at a bottom surface of the mounting cavity, and the mounting hole is formed at a middle part of the transverse plate.

4. The gas heater of claim 1, wherein a combustion cavity is formed at a top of the heater body; a wind-shielding assembly is detachably mounted around the combustion cavity; the wind-shielding assembly comprises a plurality of separator plates.

5. The gas heater of claim 4, wherein the wind-shielding assembly further comprises a mounting seat mounted to each corner of the combustion cavity;

each mounting seat is provided with a claw that hooks at a corresponding corner of the combustion cavity; each mounting seat also comprises slots in which adjacent separator plates are inserted respectively.

6. The gas heater of claim 1, wherein the input end of the gas inlet pipe is a screw joint, and the screw joint penetrates through the through hole or the mounting hole and is fixed by a nut.

7. The gas heater of claim 1, wherein a control switch is arranged on a side surface of the heater body; the control switch is configured to control the gas valve and the ignition device; the ignition device comprises a gas collecting hood arranged on one side of the burner, and an ignition pin and a thermocouple arranged in the gas collecting hood.

8. The gas heater of claim 1, wherein at least one gas inlet hole is arranged on a circumferential surface of the pipe adapter.

* * * * *